United States Patent [19]

Grubbs et al.

[11] Patent Number: 5,065,774

[45] Date of Patent: Nov. 19, 1991

[54] PROCESS FOR EXPANDING TOBACCO UNDER MODERATE CONDITIONS

[75] Inventors: Robert E. Grubbs, Winston-Salem; Richard G. Haberkern, King; Michael E. Edwards, Windsor, all of N.C.; James D. Frederickson, late of Winston-Salem, N.C., by Agnes C. Fredrickson, executrix

[73] Assignee: R. J. Reynolds Tobacco Company, Winston-Salem, N.C.

[21] Appl. No.: 395,877

[22] Filed: Aug. 18, 1989

[51] Int. Cl.[5] ..... A24B 3/18

[52] U.S. Cl. ..... 131/291; 131/296

[58] Field of Search ..... 131/291, 296

[56] References Cited

U.S. PATENT DOCUMENTS 3,524,451 8/1970 Fredrickson .
3,524,452 8/1970 Moser et al. .
3,683,937 8/1972 Fredrickson et al. .
4,235,250 11/1980 Utsch .
4,258,729 3/1981 de la Burde et al. .
4,336,814 6/1982 Skyes et al. .
4,531,529 7/1985 White et al. .
4,641,665 2/1987 Hedge et al. .
4,696,313 9/1987 Brown et al. ..... 131/296

FOREIGN PATENT DOCUMENTS 2183442A 6/1987 United Kingdom .

*Primary Examiner*—V. Millin
*Attorney, Agent, or Firm*—Grover M. Myers

[57] ABSTRACT

The invention is directed to a process for increasing the filling capacity of tobacco under moderate conditions of temperature and pressure. Tobacco is impregnanted with a low boiling impregnant and thereafter subjected to a pre-expansion treatment. The pre-expansion treatment includes a pre-expansion temperature which is above the atmospheric boiling point of the impregnant and which is at least ten degrees below the critical temperature of the impregnant; and a pressure which is at least five atmospheres above the boiling point pressure of the impregnant at the pre-expansion temperature. Under these conditions, the impregnant is maintained primarily in the liquid phase throughout the pre-expansion treatment. Following the pre-expansion treatment, the pressure of the treated tobacco is rapidly reduced to a pressure below the boiling point pressure of the impregnant to thereby effect tobacco expansion without the need for a separate heating step.

20 Claims, No Drawings

PROCESS FOR EXPANDING TOBACCO UNDER MODERATE CONDITIONS

BACKGROUND OF THE INVENTION

This invention relates to a process for expanding tobacco to increase its filling capacity, i.e., to reduce its bulk density. The process is particularly suitable for treating cigarette cut filler.

During curing, tobacco leaf loses moisture and shrinks. Subsequent storage and treatments such as cutting contribute to the shrunken or collapsed condition of the entire leaf, particularly the thin lamina portion which is used for cut filler.

Prior to about 1970, several processes were suggested or proposed for increasing filling capacity of tobacco. No commercial success was reported as to such pre-1970 process. In 1970, U.S. Pat. No. 3,524,451 to Fredrickson, and U.S. Pat. No. 3,524,452 to Moser et al. were granted. These patents describe commercially significant processes for expanding or puffing tobacco by contacting the tobacco with a volatile impregnant and then heating the tobacco by rapidly passing a stream of hot gas in contact therewith to volatilize the impregnant and expand the tobacco. These flash-expansion processes have now been widely accepted and put into extensive commercial use throughout the world.

A variation of these processes is described in subsequently issued U.S. Pat. No. 3,683,937 to Fredrickson et al. which discloses a process for puffing or expanding tobacco by contacting the tobacco with vapors of a volatile impregnant while maintaining the temperature above the boiling point of the impregnant at the prevailing pressure so that the tobacco remains free of any liquid or solid form of the impregnant and thereafter rapidly reducing the pressure or rapidly increasing the temperature to provide vapor releasing conditions and expansion of the tobacco. This patent reported tobacco expansion employing Freon-12 as an impregnant with heating of the impregnated tobacco at a temperature of 56° C. in a closed apparatus at a pressure of 202 psig. The thus pressurized and impregnated tobacco was expanded by rapidly venting the closed apparatus to the atmosphere without a subsequent heating step. A filling capacity increase of 60 percent was reported.

U.S. Pat. No. 4,235,250 to Utsch, along with U.S. Pat. No. 4,258,729 to Burde et al. and U.S. Pat. No. 4,336,814 to Sykes et al. disclose the use of carbon dioxide as the expansion agent in a process wherein tobacco is treated with carbon dioxide gas or liquid to impregnate the tobacco, and thereafter the carbon dioxide-impregnated tobacco is subjected to rapid heating conditions to volatilize the carbon dioxide and thereby expand the tobacco.

U.S. Pat. No. 4,696,313 to Brown et al. discloses a process similar to the Fredrickson et al. '937 process wherein tobacco is impregnated with a liquid impregnant and heated in a closed vessel. The temperature and pressure conditions achieved in the vessel are such that the temperature is above the boiling point temperature of the impregnating agent at the pressure achieved in the closed vessel. Thereafter, the pressure is suddenly vented from the first vessel into a second vessel to expand the tobacco. This patent reports increases in filling volume of tobacco/tobacco stem mixtures ranging from 52 percent to 70 percent. A similar process which employs a mixture of volatile expansion agents, one of which is water soluble and the other of which is water insoluble, is disclosed in U.S. Pat. No. 4,641,655 to Hedge et al. while an apparatus for conducting such expansion processes is described in U.K. Patent Application 2,183,442A to Brown et al., published June 10, 1987.

U.S. Pat No. 4,531,529 to White et al. discloses a process for increasing filling capacity of tobacco by contacting the tobacco with an expansion agent at or near supercritical conditions of pressure and temperature and thereafter rapidly reducing the pressure to provide tobacco expansion without subjecting the tobacco to additional heat.

The tobacco expansion processes which employ a postheating step are known to affect the taste of the tobacco. This is believed due to loss of some volatile components during the post-impregnation heating step. Similarly, with those processes which do not employ a post-heating step, if the temperature is relatively high during impregnation and subsequent pressure reduction of the treated tobacco, volatile components of the tobacco can be lost during the pressure reduction step.

SUMMARY OF THE INVENTION

This invention provides a tobacco expansion process which can be conducted at relatively moderate temperature conditions and which does not require a heating step to achieve expansion. The process of the invention can thus be used to puff or expand tobacco without significant adverse impact on tobacco taste. In accordance with the invention, tobacco is expanded by impregnating the tobacco with a volatile impregnant having a boiling point less than 100° C. The impregnated tobacco is subjected to pre-expansion temperature and pressure conditions including a pre-expansion temperature which is advantageously above the atmospheric boiling point temperature of the impregnant and a pre-expansion pressure which is at least about 5, and preferably about 10 or more, atmospheres above the boiling point pressure, i.e. liquification pressure, of the impregnant at the chosen pre-expansion temperature. Thus, the impregnant is maintained under liquefying conditions during this pre-expansion treatment stage. Pressurization during the pre-expansion treatment is accomplished by means of an inert gas, which is preferably carbon dioxide. Thereafter, the pressure of the treated tobacco is rapidly reduced to a pressure substantially below the boiling point pressure of the impregnant at the chosen pre-expansion temperature resulting in tobacco expansion without the need for a subsequent heating step.

The invention departs significantly from prior tobacco expansion processes in that the impregnated tobacco is treated at a temperature and at a pressure substantially outside the conditions at which the impregnant can exist primarily in vapor form. Because required heating of the impregnated tobacco is minimal, the process of the invention can be conducted at temperatures below 100° C. throughout its entirety. This can provide benefits including minimal moisture loss during tobacco expansion, thus eliminating or minimizing the need for post-expansion tobacco reordering. Additionally, loss of volatile flavor components of the tobacco can be minimized. Although superatmospheric pressures are required in the process of the invention, pressure requirements are substantially less than supercritical tobacco expansion processes resulting in improved equipment and energy economies. Additionally, the amount of impregnant employed in the process is minimal because a pressurizing gas such as carbon dioxide is used to increase pressure during the pre-expansion stage.

The process of the invention can be applied to cured or uncured tobacco in the form of leaf (including stems and veins), strips (leaf with stem removed), or cigarette-cut filler (strips cut or shredded for cigarette making). Tobacco in the form of cut filler is preferred because the process is more effective with the smaller particle size and also some of the increase in filling capacity may be lost if expanded tobacco in the form of leaf or strip were subsequently run through a cutter or shredder. Because the process of the invention is conducted under moderate conditions such that adverse impact on tobacco taste is eliminated or minimized, the invention may be applied to a whole blend, that is, the complete blend of tobaccos used to make a particular cigarette. Since filling capacity increases achieved according to the invention can be controlled from about 40–90%, or more, the filling capacity of the entire blend can be the same when the entire blend is puffed according to this invention as compared to the prior art practice of adding 10–40% highly puffed tobacco to a blend of unpuffed or unexpanded tobaccos. Additionally, when the entire blend is puffed as per the present invention, less undesirable harshness would be added to the whole blend, as may sometimes be the case when a highly puffed, heat treated tobacco is added to the blend.

DETAILED DESCRIPTION OF THE INVENTION

Tobacco treated in accordance with the invention should be in pliable, moist condition prior to treatment. Traditionally, this is accomplished by adjusting the moisture content of the tobacco to within the range of 8–30%, preferably 10–16%. Because only little moisture is lost by the tobacco treated according to the process of this invention, substantially lower moisture contents are preferably employed, for example, 10–14%. Additionally, it has been found that moisture content of the treated tobacco can have an impact on the degree of puffing achieved, particularly in those situations where the temperature during the pre-expansion pressurization treatment is a relatively low temperature, i.e. less than about 150°–160° F. In those instances, moistures in the range of 11–13% are preferred. These levels are additionally preferred in that post-expansion drying or reconditioning is not required prior to further processing of the tobacco or the subsequent manufacturing of the final cigarette.

Impregnating agents which are used in accordance with this invention are those inert agents that impregnate the bulk of the tobacco to thoroughly permeate the cellular structure of the tobacco and cause or assist in expansion of the cellular structure when pressure is released. The term "inert" is used herein to mean that the expansion agent does not form any undesirable components in meaningful amounts.

The impregnating agents used in accordance with this invention are normally liquid, volatile materials, having an atmospheric boiling point below 100° C., preferably below about 80° C., most preferably below 60°–70° C., and additionally, preferably have a boiling point above 0° C., preferably above 20° C.

Thus, volatile impregnating agents which may be used in the invention include straight and branched chain alkanes including cycloalkanes such as butane, isobutane, pentane, isopentane, hexane, isohexane, cyclopentane, cyclohexane and the like; alcohols such as methanol, ethanol, propanol and the like; ethers such as ethyl methyl ether, diethyl ether and the like; esters such as methyl acetate, ethyl formate, methyl propionate, and the like; ketones such as acetone and the like; halogenated alkane hydrocarbons such as trichlorofluoromethane, carbon tetrachloride, dichlorofluoromethane, ethyl chloride, ethyl bromide, trichlorotrifluoroethane, and the like. Preferred impregnating agents are the relatively non-polar, non-oxygenated compounds which are substantially immiscible in water. In this regard, it has been found that pentane is a particularly preferred impregnating agent as producing expanded tobacco having particularly desirable taste characteristics.

The impregnating agent employed in the process of the invention is advantageously applied in a manner and amount to provide a relatively small amount of the impregnant in the tobacco to be expanded and in a manner such that the expansion agent will fully impregnate the cellular structure of the tobacco. Thus, the impregnating agent is typically applied to provide an amount ranging from about 0.1 ml. to about 5 ml. per gram of moist tobacco, preferably from about 0.4 to about 1.5 ml. per gram of tobacco, most preferably from about 0.4 to about 0.7 ml. per gram of tobacco depending on density and/or molecular weight of the impregnant. Thorough impregnation of the impregnant into the tobacco can be accomplished by any of various means which will be apparent to those skilled in the art. For example, the impregnating agent can be applied to the tobacco and allowed to equilibrate at room temperature conditions for a period of from several days to several weeks. Alternatively, the impregnating agent can be applied to the tobacco and the impregnated tobacco mildly heated in a sealed apparatus under conditions such that the impregnating agent is maintained at above its boiling point and at mild superatmospheric pressure of up to, for example 20–100 psig. for a period of up to several hours in order to fully impregnate the cellular structure of the tobacco. Similarly, tobacco may be continuously passed via screw conveyor or similar means through a high pressure zone where it is counter-currently treated with a gas of the impregnating agent at a temperature above the atmospheric boiling point of the impregnating agent and at a convenient pressure of between atmospheric and up to several atmospheres higher. Alternatively, the tobacco can be submerged in impregnating agent which in turn is in the form of a liquid for up to several hours to accomplish thorough impregnation.

The impregnated tobacco is then admitted into a batch or continuous treatment high pressure zone wherein it is subjected to pre-expansion temperature and pressure conditions wherein the expansion agent is maintained as a liquid and at a pressure substantially above the liquefying pressure of the expansion agent at the pre-expansion temperature. During this pre-expansion treatment stage, the tobacco is maintained at a temperature substantially above the expansion stage boiling point temperature of the impregnating agent. Typically and conveniently, the subsequent expansion stage will be conducted at or near atmospheric pressure, and thus the pre-expansion temperature will be a temperature substantially above the atmospheric boiling point temperature of the impregnating agent. Preferably, the pre-expansion temperature will be at least 10° C. above the expansion stage boiling point temperature of the impregnating agent, and may range up to 125° C. although preferably the temperature is kept below 100° C. The temperature should be kept below the critical temperature of the impregnating agent. Thus, the temperature is maintained at least 10°-20° below the critical temperature of the impregnating agent during the pre-expansion treatment. It will be recognized that the critical temperature is that temperature above which the impregnating agent can no longer exist as a liquid. Thus, the impregnating agent is maintained below this temperature so that it can be maintained as a liquid during the pre-expansion treatment. Additionally, those skilled in the art will recognize that at conditions close to the critical temperature, the pressure needed to maintain the impregnating agent as a liquid can be extremely high, thus undercutting economies particularly in regard to equipment requirements. In order to maximize expansion and minimize any adverse impact on tobacco flavor, the pre-expansion temperature is best kept below 100° C., preferably below about 90° C. Thus, the pre-expansion temperature is best maintained between about 10-20 degrees greater than the atmospheric boiling point temperature of the impregnating agent and about 90° C.

Because the pre-expansion treatment step is conducted under conditions such that the impregnating agent is maintained primarily in liquid form, an inert gas is employed to raise the pressure experienced by the impregnated tobacco substantially above the boiling point pressure or liquefying pressure of the expansion agent at the pre-expansion temperature chosen. The term "inert gas" is used herein to mean that the gas does not react chemically with the expansion agent or tobacco or otherwise interact with the tobacco or expansion agent to form any undesirable components in meaningful amounts. Inert gases which can be employed include carbon dioxide, nitrogen, helium, low boiling point fluorocarbons, chlorocarbons, chlorofluorocarbons and low boiling alkanes such as methane, carbon disulfide, and the like. Advantageously, non-flammable gases such as nitrogen and carbon dioxide are employed, and most advantageous results have been obtained with carbon dioxide.

The pressure employed during the pre-expansion treatment stage is maintained at least about 5 atmospheres above the liquefying or boiling point pressure of the impregnating agent at the particular pre-expansion temperature. More preferably, the pressure is maintained at greater than about 10 atmospheres, most preferably about 15 atmospheres or more above the boiling point pressure of the expansion agent at the existing pre-expansion temperature. Typically a convenient pressure in the range of 250-900 psig., preferably 400-800 psig will be employed.

The impregnated tobacco is maintained under pre-expansion temperature and pressure conditions for a period of time sufficient to achieve substantial equilibrium and uniformity throughout the impregnated tobacco. Thus, depending upon the amount of tobacco treated, the pre-expansion temperature employed, the pre-expansion pressure employed, the specific impregnant and the amount of impregnant, the pre-expansion treatment step may be conducted for a time ranging from several minutes up to several hours, preferably from about 2 to about 10 minutes, for example, 5 minutes.

Following pre-expansion treatment, the pressure in the pre-expansion treatment zone is rapidly reduced causing the tobacco to expand without a further heat treatment step. Preferably, depressurization is accomplished in less than about 1 minute, more preferably in less than about 30 seconds, most preferably 20 seconds or less, for example 10 seconds or less. It has been found that maximum expansion occurs when the rate of depressurization is maximized.

During depressurization, the temperature of the treated tobacco is maintained substantially constant, although temperature may typically drop 5° to 10° F. or greater due to evaporation of the expansion agent. If necessary or desirable, external heat may be applied to the treatment zone during depressurization in order to minimize the change in temperature of the impregnated tobacco.

The degree of tobacco expansion can be increased somewhat by repeating the pre-expansion treatment at least once, immediately following depressurization. Thus, following depressurization, the tobacco can immediately be repressurized up to the pre-expansion pressure using the same inert gas or the inert gas recovered during depressurization and held until the desired temperature and pressure has been stably achieved for a period of, for example, 2 minutes to 30 minutes, e.g. 5 minutes, followed by rapid depressurization. This and other subsequent pre-expansion treatments of the impregnated tobacco can be conducted in the same vessel as the first pre-expansion treatment stage, or the partially expanded tobacco can be recovered in an intermediate step, and quickly and without further impregnation be transferred to a second vessel for similar or identical treatment as conducted in the first vessel and following depressurization, tobacco of enhanced filling power, recovered. Such subsequent treatment can also effectively decrease the amount of retained impregnant in the expanded tobacco.

The process of this invention can be conducted using any of various high pressure treating vessels or apparatus as will be known to those skilled in the art. Thus, for example, the process may be conducted using the apparatus disclosed in U.S. Pat. No. 4,554,932 to Conrad et al. which is directed to a fluid pressure treating apparatus including a cylindrical tubular shell with a reciprocal spool assembly, the disclosure which is incorporated herein by reference. Alternatively, the process of the invention may be conducted in a continual or batch process employing the tobacco treating apparatus disclosed in U.S. Patent application Ser. No. 07/367,589 filed June 19, 1989, and entitled Process and Apparatus for the Expansion of Tobacco by Anatoly I. Kramer which discloses a process and apparatus for expanding tobacco wherein a high pressure dynamic pressure seal, preferably including advanced ceramic surfaces slidably engaged, and capable of maintaining stable pressure conditions in an impregnation chamber while in relative movement and while withstanding abrasive action of materials typically present in tobacco, is employed. Alternatively, conventional batch-type high pressure treatment vessels as will be known to those skilled in the art can be employed in the process of the invention.

Impregnant agent gases removed from the tobacco during the depressurization step may be recovered by known means for reuse, if desired. The impregnating agent is expelled from the tobacco during depressurization and the tobacco is removed from the pressure zone or vessel after the pressure has been reduced. No heating step is required subsequent to depressurization either to cause expansion of the tobacco or to set or fix the tobacco in expanded condition. Preferably, for ease and economies in carrying out the process, depressurization is complete at 0 psig, i.e. at atmospheric pressure. However, depressurization to a pressure above or below that of atmospheric pressure is also contemplated and considered to be within the scope of this invention.

Although not fully understood, it is believed that expansion achieved according to this invention is due in significant part to physical effects during that portion of the pressure reduction step occurring while the impregnating agent is maintained as a liquid. Thus, pre-expansion treatment followed by rapid pressure reduction of impregnated tobacco and wherein the pre-expansion pressure is at or just above the boiling point pressure of the expansion agent, results in little or no expansion of the tobacco without a heating step. But increasing the pressure 10–15 atmospheres above the boiling point pressure of the impregnant, and employing a pressurizing gas such as carbon dioxide, provides significant tobacco expansion (under otherwise identical conditions). On the other hand, when the tobacco is not impregnated, and thus no impregnating agent is present, simply pressurizing the tobacco to about 300 to 600 psig with an inert gas such as carbon dioxide or nitrogen while maintaining the tobacco at, for example, 60°–80° C., followed by rapid depressurization, likewise results in substantially no tobacco expansion.

It has been found that with burley/flue cured blends of tobacco treated according to this invention under relatively moderate temperature and pressure conditions, e.g. 60°–80° C. and 300–600 psig, to achieve filling capacity increases in the range of 50–80%; surprisingly, there is significantly little adverse impact on tobacco smoking flavor. Flue cured tobacco, alone, expanded according to the process of the invention, expands even to a greater extent, still without significant adverse impact on taste. This invention thus provides a process which can be applied to all or a greater portion of the tobacco blend while providing a filling capacity for the whole blend which is the same as prior art blends consisting primarily of unexpanded tobacco with 10–30% addition of highly expanded tobacco. At the same time, cigarettes containing tobacco puffed according to this invention can provide taste comparable to the taste of a cigarette which includes no puffed tobacco.

Tobacco moisture content as described herein is expressed as the percent reduction in tobacco weight upon heating in a convection oven for 5 minutes at 100° C. Filling capacity measurements of expanded and untreated tobacco samples were performed using a specially designed and electronically automated filling capacity meter in which a solid piston of about 3.625 inches in diameter that is slidably positioned in the cylinder exerts pressure of 26 psi on tobacco samples located in this cylinder. These parameters simulate the packing conditions to which tobacco is subjected on cigarette making machine during the formation of cigarette rod. The moisture content of the tobacco affects the filling values determined by this method; therefore, comparative filling capacities of tobacco, both before and after expansion, were made with tobacco having essentially the same moisture contents. The percent increase in the filling capacity, or percent expansion, was computed by substracting the filling capacity of the unexpanded control sample from the filling capacity of the expanded sample; dividing this difference by the filling capacity of the control sample; and multiplying this quotient by 100.

The following examples are provided to provide a more complete understanding of the invention.

EXAMPLE 1

Tobacco expansion experiments were conducted using a cylindrical tubular shell with reciprocal spool assembly apparatus as described in U.S. Pat. No. 4,554,932 to Conrad et al. The apparatus included a pressure vessel having a volume of 4.5 liters capable of containing pressures above 100 atmospheres. A thermocouple was installed inside the vessel to measure the temperature of vessel contents and a pressure gauge indicated the pressure in the vessel. Inert gas was introduced into the vessel through a gas line including a throttle valve. Expansion agent vapor was vented from the vessel using a tubing line provided with a throttle valve. The vessel was heated by submersion in a liquid bath.

A number of samples of tobacco, each weighing 300 grams and having a 13% moisture content, were prepared. The tobacco samples consisted of a blend of burley and flue-cured tobacco lamina. The samples were each treated with 180 ml. of pentane, placed inside of a sealed container, and the pentane allowed to equilibrate for two weeks.

The pentane equilibrated tobacco was then placed in the previously described pressure vessel and treated under the conditions set forth below. The tobacco moisture content listed in the table is the percent moisture in the expanded sample, expressed in weight percent. Depressurization time for each experiment was about 15 seconds.

| Test | Bath Temp. | Chamber Pressure | Inert Gas | Chamber Temp. | Depressurized Chamber Temp. | Total Time | Pressurized # Cycles | % Moisture |
|---|---|---|---|---|---|---|---|---|
| 1 | 230° F. | 600 PSI | $CO_2$ | 180° F. | 164° F. | 5 min. | 2 | 10.4 |
| 2 | 228° F. | 600 PSI | $CO_2$ | 186° F. | 170° F. | 5 min. | 2 | 10.9 |
| 3 | 226° F. | 600 PSI | $CO_2$ | 185° F. | 170° F. | 5 min. | 2 | 10.8 |
| 4 | 198° F. | 600 PSI | $CO_2$ | 160° F. | 147° F. | 5 min. | 2 | 11.7 |
| 5 | 196° F. | 600 PSI | $CO_2$ | 161° F. | 149° F. | 5 min. | 2 | 11.7 |
| 6 | 197° F. | 600 PSI | $CO_2$ | 161° F. | 131° F. | 5 min. | 2 | 11.7 |

The samples were recovered and filling capacity increase was determined. It was found that the average increase in filling capacity was 51%.

EXAMPLE 2

The experiments of Example 1 were repeated except that the chamber temperature employed was in the range from 165°–185° F., and the pressure employed was 600 psig. A ball valve was added for faster depressurization. Depressurization was accordingly accomplished in about 9 seconds. Pre-expansion treatment was conducted twice. It was found that the tobacco experienced an increase in filling power of about 60%.

EXAMPLE 3

The experiments of Example 1 were repeated except that the chamber temperature was in the range of from 155° to 180° F. and the pressure employed was 600 psig. A ball valve was added to a larger gas line so that depressurization was accomplished in about 3 seconds. It was found that the tobacco experienced a 90% increase in filling power.

EXAMPLE 4

An experiment as described in Example 1 was repeated except that only a single pressurization cycle was employed. Chamber temperature during the single pressurization cycle was about 165° F. Pressure employed was about 600 psig. It was found that the tobacco had an average increase in filling capacity of about 40%.

EXAMPLE 4 (Comparative)

Experiments as in Example 1 were repeated except that no impregnant was employed. The same tobacco mixture was pressurized with $CO_2$ to a pressure of 600 psig, and the chamber was kept at 175°-180° F. This pre-expansion treatment was conducted twice. The tobacco experienced substantially no increase in filling capacity.

EXAMPLE 5

Experiments were repeated as in Example 1. Conditions employed are set forth below. In each case the pressurizing, inert gas employed was carbon dioxide. In each case, the impregnating agent was 180 ml. pentane applied to 300 g. tobacco samples and allowed to equilibrate for two weeks. In each case the tobacco was pressurized twice for five minutes at the pressures shown below. Expansion results are as set forth below.

| Test | Bath Temp. | Chamber Pressure | Chamber Temp. | Depres. Chamber Temp. | % Mois. Before Expan. | % Expan. |
|---|---|---|---|---|---|---|
| 1 | 206° F. | 600 psig | 171° F. | 157° F. | 12.7 | 53 |
| 2 | 210° F. | 500 psig | 173° F. | 156° F. | 12.7 | 39 |
| 3 | 214° F. | 400 psig | 176° F. | 165° F. | 12.2 | 32 |
| 4 | 215° F. | 300 psig | 177° F. | 169° F. | 12.0 | 25 |
| 5 | 209° F. | 200 psig | 175° F. | 171° F. | 12.0 | 17 |
| 6 | 218° F. | 100 psig | 174° F. | 170° F. | 12.9 | 10 |

It can be seen that the pressurization is an important factor in the amount of expansion obtained.

EXAMPLE 6

A series of examples were conducted using pentane as the impregnant, and nitrogen as the pressurizing gas. In these examples 400 gram samples of the all flue-cured tobacco were impregnated with 240 ml. of pentane placed in a sealed container and allowed to equilibrate overnight. Pressure in the pressurization chamber was varied from 600 psig up to 1600 psig. The chamber temperature ranged from about 210° F. up to about 220° F. The pressurization time was about 10 minutes.

It was found that the average increase in filling capacity of the samples treated at 600 psi was about 12%. The average increase in filling capacity of samples treated at 1200 psi was 21-22%. The increase in filling capacity of the sample treated at 1600 psi was about 28%.

It is believed that filling capacity increases could be substantially improved in this series of tests by changing the impregnation step so that the tobacco is more thoroughly impregnated with the expansion agent, pentane; by increasing the pressure release rate or both.

EXAMPLE 7

The process of Example 1 was repeated using ethyl acetate as an impregnant. In this experiment, 120 ml. of ethyl acetate was applied to 200 grams of the same tobacco as in Example 1 and was allowed to equilibrate within the tobacco, held in a sealed container for five days. The impregnation chamber temperature was 130° F.; the chamber pressure was 600 psi. The inert pressurization gas was $CO_2$ and the pressurization time was 10 minutes. During depressurization, the temperature dropped from 155° F. to 64° F. The number of pressurization cycles was 3, each lasting about 3 minutes. It was found that the tobacco had an increase in filling capacity of about 31%.

EXAMPLE 8

In this example, ethyl alcohol was impregnated in an amount of about 120 ml. onto 200 grams of the same tobacco as in Example 1 and allowed to equilibrate for five days. The chamber temperature during pre-expansion pressurization was 154° F.; the pressure was 900 psi and the inert gas employed Was carbon dioxide. Three pressurization cycles were employed as in the previous example. It was found that the tobacco had achieved an increase in filling capacity of about 45%.

EXAMPLE 9

The process of Example 8 was repeated except that Freon 11 was used as the expansion agent. It was found that a 40.6% increase in filling capacity was obtained.

EXAMPLE 10

A series of examples were conducted using hexane as the expansion agent with nitrogen as the inert gas. 400 gram samples of 100% flue-cured tobacco were treated with 240 ml., each, of hexane and allowed to equilibrate overnight. The samples were pressurized with nitrogen to a chamber pressure of 600 psi at a chamber temperature of 208° F. Three pressurization cycles were conducted over a total time of about 10 minutes. It was found that the average increase in filling capacity of the treated tobacco was about 11%. It is believed that the filling capacity increase can be substantially improved by improving the impregnation step, or by improving the pressure release step.

The invention has been described in considerable detail with reference to preferred embodiments thereof. However, it will be recognized that variations and modifications can be made within the spirit and scope of the invention as described in the foregoing specification and defined in the following claims.

We claim:

1. The process for increasing the filling capacity of tobacco comprising the steps:

(a) impregnating tobacco with a volatile impregnant having a boiling point less than 100° C.;

(b) subjecting the tobacco to pre-expansion temperature and pressure conditions including a pre-expansion temperature which is above the atmospheric boiling point of the impregnant and a pre-expansion pressure which is at least about 5 atmospheres above the boiling point pressure of the impregnant at said pre-expansion temperature, said pre-expansion temperature being at least about 10° C. below the critical temperature of the impregnant, whereby the impregnant is maintained primarily in the liquid phase throughout the pre-expansion treatment; and (c) rapidly reducing the pressure of the treated tobacco to a pressure below the boiling point pressure of the impregnant at said pre-expansion temperature to thereby effect expansion of the tobacco without the need for a subsequent heating step.

2. The process of claim 1 wherein said pre-expansion treatment is accomplished by treating the impregnated tobacco in a high pressure zone with an inert gas maintained under a pressure within the range of 250–900 psig.

3. The process of claim 2 wherein said inert gas comprises at least one of the group: nitrogen, carbon dioxide, carbon disulfide, alkanes, fluorocarbons, chlorocarbons and chlorofluorocarbons.

4. The process of claim 3 wherein said inert gas comprises carbon dioxide.

5. The process of claims 1, 2, 3 or 4 wherein said impregnating agent is selected from the group consisting of alkanes, alcohols, and halogenated alkane hydrocarbons.

6. The process of claims 1, 2, 3 or 4 wherein said impregnating agent is selected from the group consisting of butane, pentane, hexane and heptane.

7. The process of claims 2, 3 or 4 wherein said pressure in said high pressure zone is within the range of 400–800 psig.

8. The process of claims 1, 2, 3 or 4 wherein the pre-expansion temperature is a temperature below about 90° C.

9. The process of claims 1, 2, 3 or 4 further comprising the steps, following step (c), of repeating steps (b) and (c), one or more times.

10. The process of claims 1, 2, 3 or 4 wherein the tobacco impregnated in step (a) has a moisture content in the range of from about 10 to about 16%.

11. The process of claim 10 wherein said moisture content is in the range of between 11% and 14%.

12. A process for increasing the filling capacity of tobacco comprising the steps:

(a) impregnating tobacco with a volatile impregnant having a boiling point less than 100° C.;

(b) treating the impregnated tobacco in a high pressure zone with carbon dioxide gas at a pressure above about 200 psig and a temperature greater than the atmospheric boiling point of the impregnating agent and less than about 100° C.; and (c) rapidly reducing the pressure in said high pressure zone to thereby cause expansion of the tobacco without a further heating step.

13. The process of claim 12 wherein said pressure in step (b) is within the range of from about 400 to about 800 psig.

14. The process of claim 12 wherein in said treating step (b), the impregnated tobacco is maintained at said pressure greater than 200 psig for a time of from about 2 to about 30 minutes.

15. The process of claims 12, 13 or 14 wherein said volatile impregnant is selected from the group consisting of alkanes, alcohols, and halogenated alkane hydrocarbons.

16. The process of claim 15 wherein said volatile impregnant is selected from the group consisting of butane, pentane, hexane and heptane.

17. The process of claims 12, 13 or 14 wherein the moisture content of said tobacco prior to said treating step (b) is less than about 30% by weight.

18. The process of claim 17 wherein said moisture content is in the range of 10% to 16% by weight.

19. The process of claim 12 wherein following said depressurization step (c) said treating step (b) and said depressurization step (c) are repeated one or more times.

20. The process of claim 12 wherein said temperature in step (b) is less than about 90° C.

* * * * *